US010954025B2

(12) United States Patent
Rozek

(10) Patent No.: US 10,954,025 B2
(45) Date of Patent: Mar. 23, 2021

(54) CONTAINER WITH MULTIPIECE BODY

(71) Applicant: AMM Funding LLC, Lake Oswego, OR (US)

(72) Inventor: Kurt Louis Rozek, Lake Oswego, OR (US)

(73) Assignee: AMM FUNDING LLC, Lake Oswego, OR (US)

( * ) Notice: Subject to any disclaimer, the term of this patent is extended or adjusted under 35 U.S.C. 154(b) by 0 days.

(21) Appl. No.: 16/505,129

(22) Filed: Jul. 8, 2019

(65) Prior Publication Data

US 2020/0047942 A1 Feb. 13, 2020

Related U.S. Application Data

(60) Provisional application No. 62/717,074, filed on Aug. 10, 2018.

(51) Int. Cl.

| | |
|---|---|
| ***B65D 5/32*** | (2006.01) |
| ***B65D 5/44*** | (2006.01) |
| ***B65D 5/42*** | (2006.01) |

(52) U.S. Cl.

CPC ..... *B65D 5/324* (2013.01); *B65D 5/4266* (2013.01); *B65D 5/441* (2013.01)

(58) Field of Classification Search

CPC ..... B65D 5/324; B65D 5/4266; B65D 5/441; B65D 2519/00273; B65D 2519/00323; B65D 2519/00641; B65D 9/24; B31B 2120/30

USPC .... 229/122.21, 122.32, 199, 117.02, 117.01, 229/108.1, 172, 174, 919; 206/600, 386; 220/4.28, 4.08; 493/84, 89, 311

See application file for complete search history.

(56) References Cited

U.S. PATENT DOCUMENTS

| | | | | |
|---|---|---|---|---|
| 3,434,648 A | | 3/1969 | Barry | |
| 4,341,337 A | * | 7/1982 | Beach, Jr. | B65D 5/18 229/108.1 |
| 4,373,637 A | * | 2/1983 | Shippell | B65D 19/06 206/600 |
| 4,606,461 A | * | 8/1986 | Bolton, Sr. | B65D 19/20 206/600 |
| 4,793,507 A | * | 12/1988 | Delplanque | B65D 9/14 217/13 |

(Continued)

FOREIGN PATENT DOCUMENTS

EP 0020171 A1 12/1980

*Primary Examiner* — Christopher R Demeree

(74) *Attorney, Agent, or Firm* — Quinn IP Law; Colleen N. Shovlin

(57) ABSTRACT

A container may comprise a body having a top end, an opposite bottom end, a pair of opposing first and second duplex panel structures and a pair of opposing first and second sidewalls, with each of the first and second sidewalls including a pair of first and second lateral end flaps. Each of the first and second duplex panel structures may comprise an inner end wall and an outer end wall. The inner and outer end walls of the first and second duplex panel structures may be bonded together along a medial longitudinal spine. The lateral end flaps of the first and second sidewalls may be respectively sandwiched between the inner and outer end walls of the first and second duplex panel structures to lock the inner and outer end walls in position adjacent the first and second sidewalls.

30 Claims, 9 Drawing Sheets

(56) References Cited

U.S. PATENT DOCUMENTS

| | | | | | |
|---|---|---|---|---|---|
| 4,949,898 | A * | 8/1990 | Nederveld | B65D 19/20 | 206/600 |
| 5,042,713 | A * | 8/1991 | Stafford | B65D 5/32 | 229/117.01 |
| 5,056,667 | A * | 10/1991 | Coogan | B65D 19/12 | 206/600 |
| 5,215,248 | A * | 6/1993 | Moser | B65D 5/326 | 206/600 |
| 6,352,199 | B1 | 3/2002 | Gardner | | |
| 7,581,786 | B1 * | 9/2009 | Wang | A47C 7/62 | 297/188.11 |
| 7,883,001 | B2 | 2/2011 | Goodrich | | |

* cited by examiner

CONTAINER WITH MULTIPIECE BODY

CROSS-REFERENCE TO RELATED APPLICATION

This application claims the benefit of U.S. Provisional Application No. 62/717,074, filed Aug. 10, 2018, entitled "Container with Reinforced Walls," which is herein incorporated by reference in its entirety.

INTRODUCTION

Containers, e.g., boxes, cartons, and trays, are used in the packaging industry for protecting, storing, and transporting goods and may be configured for mounting on pallets to allow for handling and storage efficiencies. Such containers are oftentimes made of corrugated fiberboard and are formed by cutting, folding, erecting, and/or gluing one or more blanks or sheets thereof into the shape of a rectangular body. Closures for the top and/or bottom ends of the body may be integral therewith and formed via additional folding and/or interlocking operations, or the closures may be formed as discrete components of the containers. Some such containers may be collapsible so that, prior to use or reuse thereof, the containers may be folded into a substantially flat or "knock-down" configuration.

For purposes of economy, various containers have been developed that are formed from a single piece of corrugated fiberboard or other similar material that is cut into a one-piece blank, divided into panels by being scored along predetermined fold lines, and folded into a final desired shape. Containers formed from one-piece blanks, however, may not exhibit sufficient structural integrity when scaled up to relatively large sizes or when used in combination with heavy goods. To improve the structural integrity of such containers, the vertical sides and/or bottom ends thereof may be constructed from two or more overlapping panels for reinforcement. However, such containers may require relatively complex assembly processes and/or may require application of adhesives and/or fasteners during the final assembly process to hold the containers in a desired shape, which may undermine the ability of the containers to be reused or stored in a substantially flat configuration prior to use or reuse.

Therefore, there is a need in the packaging industry for a container made of corrugated fiberboard or another similar material that can be folded and stored in a substantially flat configuration when not in use, easily assembled without application of additional adhesives or fasteners, customized to accommodate a variety of goods of differing dimensions, and that exhibits exceptional structural integrity.

SUMMARY

A container may comprise a body having a top end, an opposite bottom end, a pair of opposing first and second duplex panel structures, and a pair of opposing first and second sidewalls extending between the first and second duplex panel structures. Each of the first and second sidewalls may include a pair of first and second lateral end flaps extending from opposite sides thereof. Each of the first and second duplex panel structures may comprise an inner end wall having an outer surface and an outer end wall having an inner surface. The outer and inner surfaces of the inner and outer end walls of each of the first and second duplex panel structures may confront one another and may be bonded together along a medial longitudinal spine that extends between the top and bottom ends of the body. Each of the first and second lateral end flaps of the first and second sidewalls may be sandwiched between the outer and inner surfaces of the inner and outer end walls of one of the first or second duplex panel structures.

Free ends of the first and second lateral end flaps of the first sidewall may be located opposite and extend toward free ends of the first and second lateral end flaps of the second sidewall. In such case, the free ends of the first and second lateral end flaps of the first sidewall may be respectively separated from the free ends of the first and second lateral end flaps of the second sidewall by the medial longitudinal spines of the first and second duplex panel structures.

The bottom end of the body may be mounted on a base.

The top end of the body may be enclosed by a cap.

Each of the first and second duplex panel structures may include a pair of lateral side flaps extending from opposite sides of its inner end wall.

Each of the first and second duplex panel structures may include an upper flap extending from an upper end of its outer end wall.

A container may comprise a cap, a base, a body having a top end and a bottom end adapted for receipt in the base. The body may comprise a pair of first and second duplex panel structures and a pair of first and second key panels. The pair of first and second duplex panel structures may have opposing inner surfaces. Each duplex panel structure may comprise an inner bracket panel and an outer butterfly panel coupled to the inner bracket panel along a medial longitudinal spine. In such case, the inner bracket panel may be formed from a one-piece blank that defines an inner end wall and a pair of lateral side flaps. In addition, the outer butterfly panel may be formed from a one-piece blank that defines an outer end wall having an inner surface that faces toward an outer surface of the adjacent inner end wall. The pair of first and second key panels may have opposing inner surfaces. Each key panel may be formed from a one-piece blank that defines a sidewall and a pair of first and second lateral end flaps. Each of the lateral end flaps of the key panels may be sandwiched between the outer surface of one of the inner end walls and the inner surface of the adjacent outer end wall to lock the inner and outer end walls in position adjacent the sidewalls.

Each of the lateral end flaps of the key panels may be held between the outer surface of one of the inner end walls and the inner surface of the adjacent outer end wall without use of an adhesive material or fastener between the lateral end flap and the adjacent inner or outer end walls.

The key panels may be held in position adjacent the duplex panel structures without use of an additional component tied or otherwise secured around a periphery of the body.

The opposing inner surfaces of the duplex panel structures may be defined by inner surfaces of the inner end walls of the inner bracket panels. In such case, the opposing inner surfaces of the key panels may be defined by inner surfaces of the sidewalls.

The inner bracket panel and the outer butterfly panel may be coupled to each other along the medial longitudinal spine by an adhesive material.

Each of the outer butterfly panels may include an upper flap. In such case, each of the outer end walls of the butterfly panels may be joined to one of the upper flaps along a fold line. In addition, the upper flaps may fold inward toward each other, over upper ends of the inner bracket panels, prior to positioning the cap over the top end of the body.

The base, the inner bracket panel, the outer butterfly panel, the key panels, and the cap each may be formed of individual corrugated board blanks.

The sidewalls of the first and second key panels may have sidewall lengths and the inner end walls may have end wall lengths. In such case, the sidewall lengths may be greater than the end wall lengths.

The base may be mounted on a pallet.

The cap may be formed from a one-piece blank and may include a roof and a flange depending from the roof. In such case, the cap may be telescopically positioned over and around the top end of the body to define an interior storage cavity.

The roof of the cap may be supported by the top end of the body.

The base may be formed from a one-piece blank and may include a floor and a peripheral sidewall extending from the floor. In such case, the floor and the peripheral sidewall of the base together may define a socket in which the bottom end of the body may be telescopically received.

The container may be moveable between a use position and a storage position. In such case, in the use position, the inner and outer end walls of the first and second duplex panel structures and the sidewalls of the first and second key panels may extend in a vertical direction from the floor of the base to the roof of the cap. In the storage position, the first and second duplex panel structures and the first and second key panels may be stacked on top of one another and stored within the socket of the base. In the storage position, the inner and outer end walls of the first and second duplex panel structures and the sidewalls of the first and second key panels may extend in a horizontal direction substantially parallel to the floor of the base.

A container may comprise a body having a first end, an opposite second end, a pair of opposing first and second duplex panel structures disposed at the first end of the body, a pair of opposing third and fourth duplex panel structures disposed at the second end of the body, a first key panel extending between the first and second duplex panel structures at the first end of the body, and a second key panel extending between the third and fourth duplex panel structures at the second end of the body. Each duplex panel structure may comprise an inner bracket panel and an outer butterfly panel coupled to the inner bracket panel along a medial longitudinal spine. The first and second key panels may have opposing inner surfaces. Each of the first and second key panels may be formed from a one-piece blank that defines an end wall of the container and a pair of first and second lateral end flaps. In such case, the first and second lateral end flaps of the first key panel may be respectively sandwiched between the inner bracket panels and the outer butterfly panels of the first and second duplex panel structures to lock the first key panel in position adjacent the first and second duplex panel structures at the first end of the body. At the same time, the first and second lateral end flaps of the second key panel may be respectively sandwiched between the inner bracket panels and the outer butterfly panels of the third and fourth duplex panel structures to lock the second key panel in position adjacent the third and fourth duplex panel structures at the second end of the body.

The first and third duplex panel structures may at least partially define a first sidewall of the container extending between the first and second ends of the body. In such case, the second and fourth duplex panel structures may at least partially define a second sidewall of the container opposite the first sidewall and extending between the first and second ends of the body.

A pair of opposing first and second battens may be disposed between the first and second ends of the body. In such case, the first batten may be partially sandwiched between the inner bracket panel and the outer butterfly panel of the first or third duplex panel structure. At the same time, the second batten may be partially sandwiched between the inner bracket panel and the outer butterfly panel of the second or fourth duplex panel structure.

Each of the first and second battens may be formed from a one-piece blank.

The opposing first and second battens may be disposed midway between the first and second ends of the body. In such case, the first batten may be sandwiched between the inner bracket panels and the outer butterfly panels of the first and third duplex panel structures to lock the first and third duplex panel structures in position adjacent one another on a first side of the body. At the same time, the second batten may be sandwiched between the inner bracket panels and the outer butterfly panels of the second and fourth duplex panel structures to lock the second and fourth duplex panel structures in position adjacent one another on an opposite second side of the body.

The first and third duplex panel structures together may define a first sidewall of the container extending between the first and second ends of the body. In such case, the second and fourth duplex panel structures together may define an opposite second sidewall of the container extending between the first and second ends of the body.

A pair of opposing fifth and sixth duplex panel structures may be disposed between the first and second ends of the body. In such case, a pair of opposing third and fourth battens may be disposed between the first and second ends of the body.

The first, third, and fifth duplex panel structures together may define a first sidewall of the container extending between the first and second ends of the body. In such case, the second, fourth, and sixth duplex panel structures together may define an opposite second sidewall of the container extending between the first and second ends of the body.

The first batten may be sandwiched between the inner bracket panels and the outer butterfly panels of the first and fifth duplex panel structures on a first side of the body. In such case, the second batten may be sandwiched between the inner bracket panels and the outer butterfly panels of the second and sixth duplex panel structures on a second side of the body. At the same time, the third batten may be sandwiched between the inner bracket panels and the outer butterfly panels of the fifth and third duplex panel structures on the first side of the body. In addition, the fourth batten may be sandwiched between the inner bracket panels and the outer butterfly panels of the sixth and fourth duplex panel structures on the second side of the body.

The first and third battens may lock the first, third, and fifth duplex panel structures together on the first side of the body. In such case, the second and fourth battens may lock the second, fourth, and sixth duplex panel structures together on the second side of the body.

DETAILED DESCRIPTION

Figure 1:
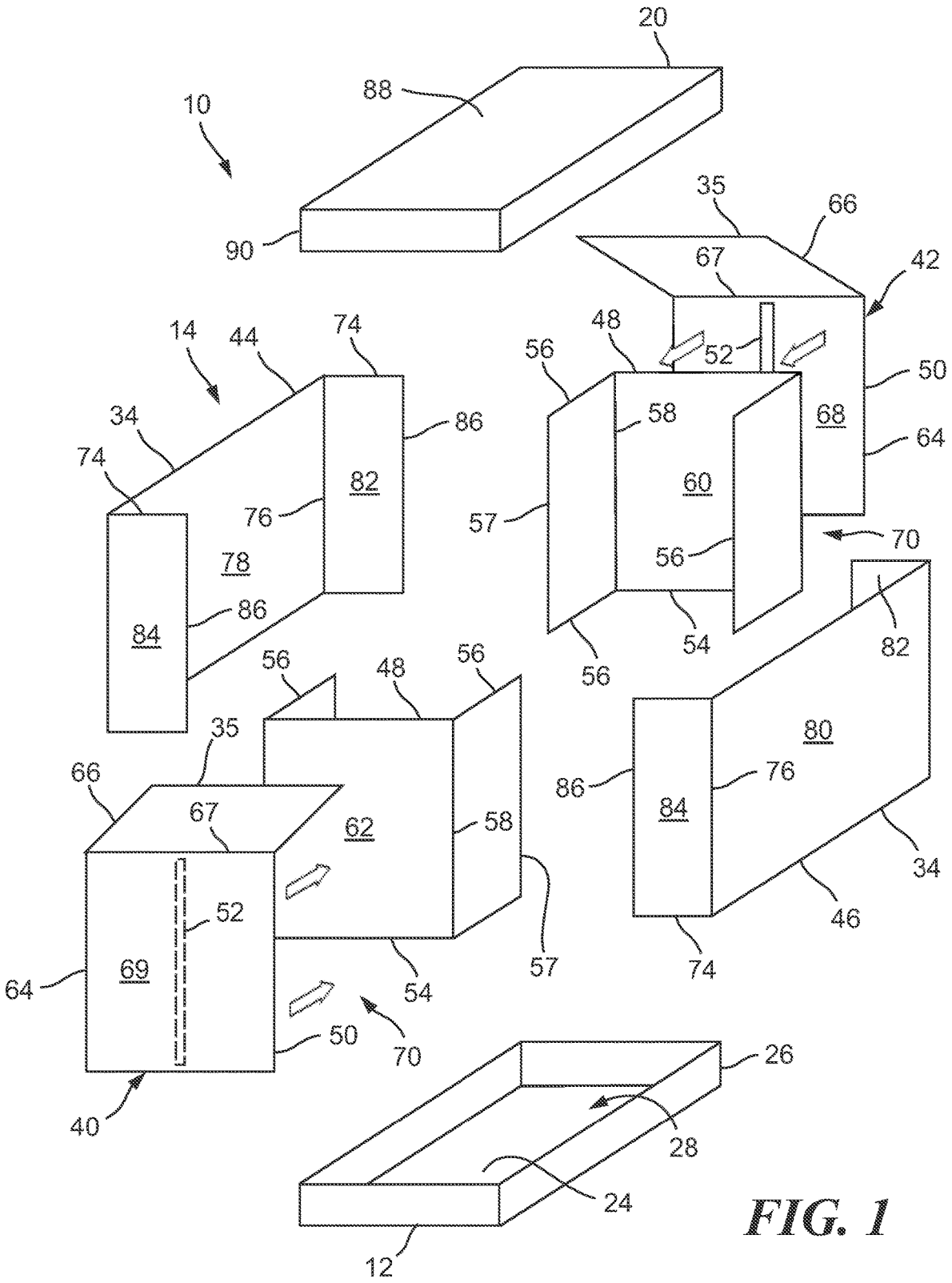
FIG. 1 is an exploded perspective view of a container comprising a base, a body, and a cap, wherein the body of the container includes a pair of opposing duplex panel structures and a pair of opposing key panels, with each duplex panel structure comprising an inner bracket panel and an outer butterfly panel.

FIGS. 1-4 illustrate a container 10 for protecting, storing, and transporting goods, in accordance with one embodiment of the present disclosure. The container 10 comprises a base 12, a body 14 including a top end 16 and a bottom end 18 (FIGS. 2 and 3), and a cap 20. The base 12, body 14, and/or cap 20 each may be manufactured from one or more blanks or sheets of a rigid or semi-rigid and flexible material that can be cut to a desired shape and scored along one or more fold lines to render the material foldable along the fold lines. The flexibility of the material should be sufficient to accommodate stresses and impacts that may occur during assembly and normal use of the container 10. Some examples of sheet materials that may be used to manufacture the base 12, body 14, and/or cap 20 of the container 10 include fiberboard (also referred to as paperboard or cardboard), plastic sheeting, corrugated fiberboard, corrugated plastic, honeycomb paper, honeycomb plastic, extruded plastic, and combinations thereof.

In the following description, the terms "upper" and "lower" generally refer to vertical directions extending between the top and bottom ends 16, 18 of the body 14. Horizontal directions generally extend transverse to the vertical directions, parallel to planes defined by the top and bottom ends 16, 18 of the body 14. The terms "inward" and "outward" respectively refer to directions toward and away from an interior storage cavity 22 defined within the container 10.

Figure 4:
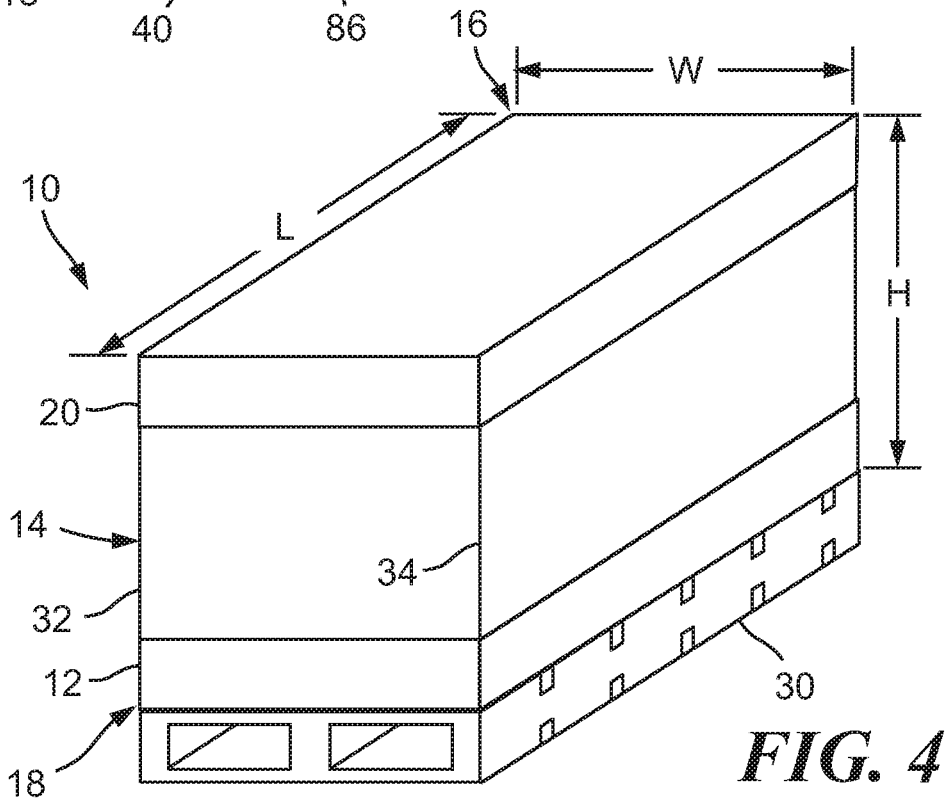
FIG. 4 is a perspective view of the container of FIG. 2 in a fully assembled use position, with top and bottom ends of the body respectively enclosed by the cap and the base of the container to define an interior storage cavity within the container.

The base 12 includes a floor 24 and a peripheral sidewall 26 extending in a vertical direction from the floor 24. The floor 24 and the peripheral sidewall 26 together define a socket 28 in which the bottom end 18 of the body 14 is slideably and telescopically received during assembly of the container 10. As shown in FIG. 4, the base 12 of the container 10 may be mounted on a pallet 30 that supports the container 10 during storage and transportation thereof. In one form, the base 12 may be formed from a one-piece blank or sheet, e.g., of corrugated board.

The body 14 of the container 10 is of polygonal cross-section and comprises a pair of opposing end walls 32 (FIGS. 2, 3, and 4) and a pair of opposing sidewalls 34 that extend in a horizontal direction between the end walls 32. At the same time, the end walls 32 and the sidewalls 34 extend in a vertical direction from the floor 24 of the base 12 between the top and bottom ends 16, 18 of the body 14. In assembly, the base 12 and the cap 20 respectively enclose the top and bottom ends 16, 18 of the body 14 and the interior storage cavity 22, and also limit relative movement of the end walls 32 and sidewalls 34 of the container 10, which imparts strength and durability to the assembled container 10.

The body 14 of the container 10 is assembled from multiple blanks or sheets of material, with the end walls 32 of the body 14 being at least partially defined by a pair of first and second duplex panel structures 40, 42 and the sidewalls 34 of the body 14 being at least partially defined by a discrete pair of first and second key panels 44, 46.

Figure 2:
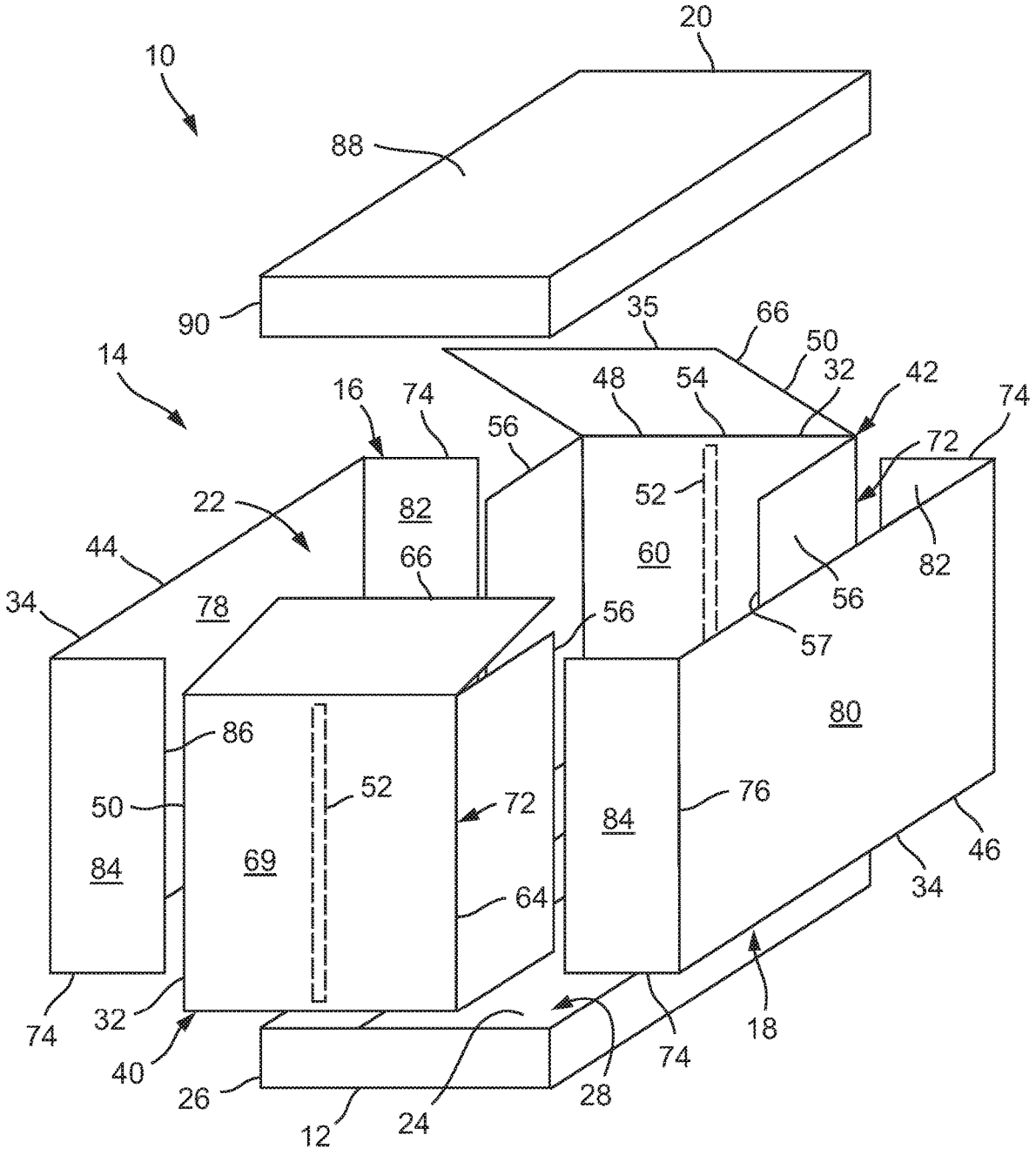
FIG. 2 is an exploded perspective view of the container of FIG. 1 in partially assembled form, with each of the inner bracket panels being physically coupled to one of the outer butterfly panels along a medial longitudinal spine to form the duplex panel structures.
Figure 3:
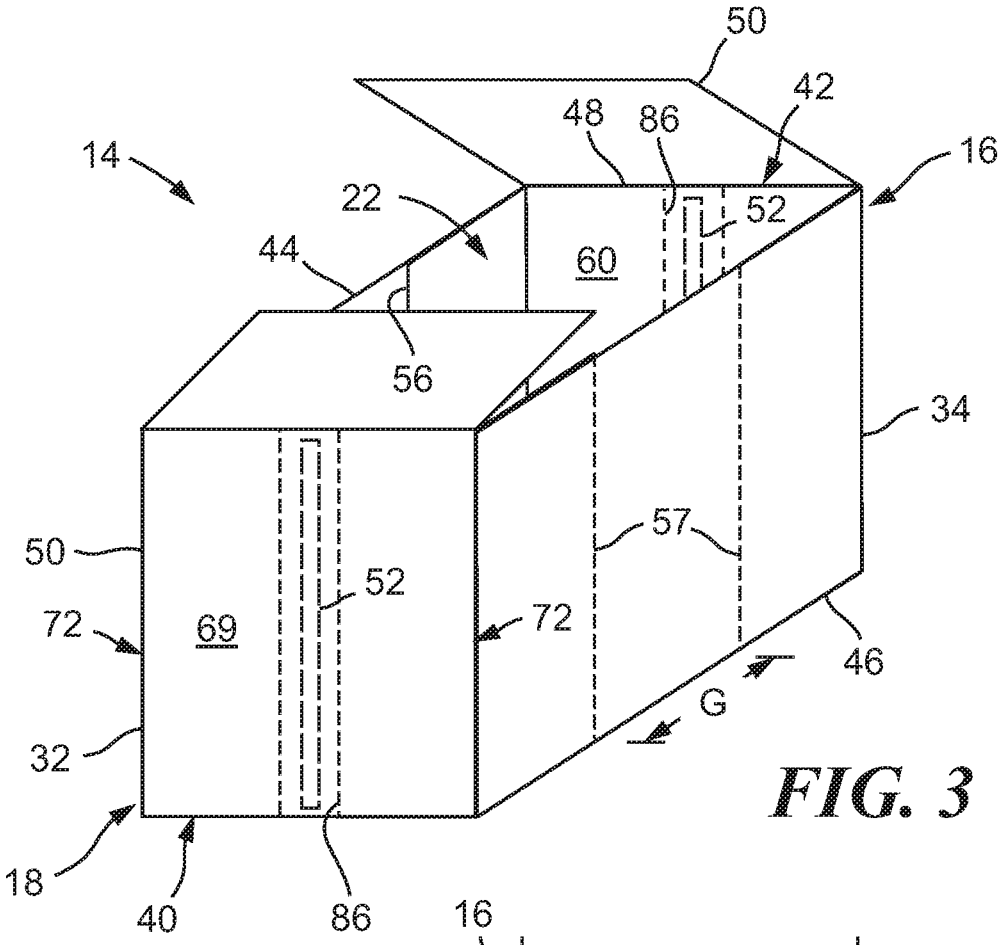
FIG. 3 is a perspective view of the body of the container of FIG. 2 in partially assembled form, wherein the duplex panel structures are locked into position adjacent the key panels.

Each of the first and second duplex panel structures 40, 42 comprises an inner bracket panel 48 and an outer butterfly panel 50 coupled to the inner bracket panel 48 along a medial longitudinal spine 52 (FIGS. 2 and 3). Each of the inner bracket panels 48 may at least partially define an inner end wall 54 of the container 10 and a pair of lateral side flaps 56 extending from opposite sides of the inner end wall 54 to free ends 57. The side flaps 56 may be joined to the inner end walls 54 along score lines or fold lines 58 defined in the inner bracket panels 48. In assembly, the inner end walls 54 of the inner bracket panels 48 have opposing inner surfaces 60 that face toward the interior storage cavity 22 and outer surfaces 62 (FIG. 1) that face away from the interior storage cavity 22. In some embodiments, each of the inner bracket panels 48 also may include an upper flap (not shown) extending from an upper end of the inner end wall 54 to a free end and/or a lower flap (not shown) extending from a lower end of the inner end wall 54 to a free end. In one form, the inner bracket panels 48 each may be formed from a one-piece blank or sheet, e.g., of corrugated board.

Each of the outer butterfly panels 50 may at least partially define an outer end wall 64 and an optional upper flap 66 extending from an upper end of the outer end wall 64. The upper flaps 66 may be joined to the outer end walls 64 along score lines or fold lines 67 defined in the outer butterfly panels 50 and may extend from the upper ends of the outer end walls 64 to free ends 35. In assembly, the outer end walls 64 have inner surfaces 68 (FIG. 1) that face toward the interior storage cavity 22 and outer surfaces 69 that face away from the interior storage cavity 22. In some embodiments, each of the outer butterfly panels 50 also may include a lower flap (not shown) that extends from a lower end of the outer end wall 64 to a free end. In one form, each of the outer butterfly panels 50 may be formed from a one-piece blank or sheet, e.g., of corrugated board.

In assembly, the inner bracket panels 48 and the outer butterfly panels 50 are positioned adjacent one another, with the outer surfaces 62 of the inner end walls 54 of the inner bracket panels 48 facing toward the inner surfaces 68 of the outer end walls 64 of the outer butterfly panels 50. The outer surfaces 62 of the inner end walls 54 are physically coupled to the inner surfaces 68 of the outer end walls 64 along the medial longitudinal spine 52, which extends in a vertical direction between the top and bottom ends 16, 18 of the body 14. In this arrangement, a pair of slots 70 is defined within each duplex panel structure 40, 42 that extend between the outer surfaces 62 of the inner end walls 54 and the inner surfaces 68 of the outer end walls 64. The slots 70 extend in a vertical direction between the top and bottom ends 16, 18 of the body 14 and in a horizontal direction from opposite sides 72 of the first and second duplex panel structures 40, 42 toward the medial longitudinal spine 52.

The inner bracket panels 48 and the outer butterfly panels 50 may be physically coupled together along the medial longitudinal spine 52 by any suitable means. For example, the inner bracket panels 48 and the outer butterfly panels 50 may be bonded or physically joined together using an adhesive or glue, which may be applied to the outer surfaces 62 of the inner end walls 54 and/or the inner surfaces 68 of the outer end walls 64. Additionally or alternatively, the inner bracket panels 48 and the outer butterfly panels 50 may be fastened together, for example, using rivets, staples, or stitches. In some embodiments, the inner bracket panels 48 and the outer butterfly panels 50 may be joined together in an interlocking relationship, without use of any additional components (e.g., adhesive or fasteners), which may require modifications to the configurations of the inner bracket panels 48 and/or the outer butterfly panels 50 shown in FIGS. 1-4. For example, in one form, the inner bracket panels 48 and the outer butterfly panels 50 may include cooperative vertical slits (not shown) that extend half the height of the panels 48, 50 (from an upper to a lower end thereof, and vice versa) that allow the panels 48, 50 to intersect one another to form a collapsible interlocking relationship therebetween.

Each of the first and second key panels 44, 46 defines one of the sidewalls 34 of the container 10 and a pair of lateral end flaps 74 extending from opposite sides of the sidewall 34. The end flaps 74 may be joined to the sidewalls 34 along score lines or fold lines 76 defined in the key panels 44, 46. The sidewalls 34 have opposing inner surfaces 78 that face toward the interior storage cavity 22 and outer surfaces 80 that face away from the interior storage cavity 22. The lateral end flaps 74 of the first and second key panels 44, 46 have inner surfaces 82 that face toward the interior storage cavity 22 and outer surfaces 84 that face away from the interior storage cavity 22. In addition, each of the lateral end flaps 74 of the first and second key panels 44, 46 extends in a horizontal direction from one of the sidewalls 34 to a free end 86 thereof. In some embodiments, each of the key panels 44, 46 also may include an upper flap (not shown) extending from an upper end of the sidewalls 34 to a free end and/or a lower flap (not shown) extending from a lower end of the sidewalls 34 to a free end. In one form, each of the first and second key panels 44, 46 may be formed from a one-piece blank or sheet, e.g., of corrugated board.

In assembly, each of the end flaps 74 of the key panels 44, 46 is received within one of the slots 70 defined in the first or second duplex panel structures 40, 42 and is sandwiched between the outer surface 62 of one of the inner end walls 54 of the inner bracket panels 48 and the inner surface 68 of one of the outer end walls 64 of the outer butterfly panels 50. After the end flaps 74 of the key panels 44, 46 are received within the slots 70, the free ends 86 of the end flaps 74 of the first key panel 44 extend in a first horizontal direction toward the medial longitudinal spines 52, and the free ends 86 of the end flaps 74 of the second key panel 46, extend in a second horizontal direction opposite the first horizontal direction toward the medial longitudinal spines 52. In addition, after the end flaps 74 of the key panels 44, 46 are received within the slots 70, the free ends 86 of the end flaps 74 of the first key panel 44 are located opposite and extend toward the free ends 86 of the end flaps 74 of the second key panel 46. The free ends 86 of the end flaps 74 of the first key panel 44 and the free ends 86 of the end flaps 74 of the second key panel 46 are located on opposite sides of and are separated from one another by the medial longitudinal spines 52 of the first and second duplex panel structures 40, 42.

After the end flaps 74 of the key panels 44, 46 are received within the slots 70, the outer and inner surfaces 62, 68 of the inner and outer end walls 54, 64 exert opposing forces on the inner and outer surfaces 82, 84 of the end flaps 74, which effectively "locks" the sidewalls 34 in position adjacent the end walls 32 of the container 10. In addition, when the bottom end 18 of the body 14 is received in the socket 28 of the base 12, the peripheral sidewall 26 of the base 12 contacts the outer surfaces 69, 80 of the duplex panel structures 40, 42 and the key panels 44, 46 and helps hold the duplex panel structures 40, 42 and the key panels 44, 46 together, for example, by preventing the end flaps 74 of the key panels 44, 46 from sliding out of the slots 70. After the end flaps 74 of the key panels 44, 46 are received within the slots 70, a fastener, e.g., a clinch staple, may be used to permanently lock the end flaps 74 of the key panels 44 within the slots 70, although this is not required.

The adhesive and/or fasteners used to couple the inner bracket panels 48 and the outer butterfly panels 50 together along the medial longitudinal spine 52 is/are the only adhesive and/or fasteners required to adequately hold the duplex panel structures 40, 42 and the key panels 44, 46 together. As such, the amount of adhesive and/or fasteners used to manufacture the container 10 is substantially less than the amount of adhesive and/or fasteners typically used in the manufacture of containers of similar rigidity. Therefore, the presently disclosed container 10 can reduce manufacturing costs without compromising the structural integrity of corrugated board containers.

The cap 20 is adapted to enclose the top end 16 of the body 14 and to enclose the interior storage cavity 22 within the container 10. The cap 20 includes a roof 88 with a flange 90 depending therefrom toward the base 12. The cap 20 may be formed from a one-piece blank, e.g., of corrugated board. The roof 88 and the flange 90 together define an opening (not shown) in which the top end 16 of the body 14 can be slideably and telescopically received until the roof 88 of the cap 20 rests against the top end 16 of the body 14. In such an arrangement, the configuration of the body 14, including the interlocking relationship between the duplex panel structures 40, 42 and the key panels 44, 46, provides sufficient support to the roof 88 of the cap 20 so that additional containers 10 and/or other articles can be stacked on top of the cap 20 during storage and/or transportation without compromising the integrity of the container 10.

In at least some embodiments, the container 10 may be configured such that the container 10 can transition from a use position (FIG. 4) to a knock-down storage position, and vice versa. In the use position, the key panels 44, 46, the inner bracket panels 48, and the outer butterfly panels 50 of the body 14 extend in vertical direction, substantially perpendicular to the floor 24 of the base 12 and at least partially define the interior storage cavity 22 of the container 10. In the storage position, the key panels 44, 46, the inner bracket panels 48, and the outer butterfly panels 50 of the body 14 may be individually folded to a substantially flat configuration, stacked on top of one another, and stored within the socket 28 of the base 12 (or within the opening in the cap 20), with the key panels 44, 46, the inner bracket panels 48, and the outer butterfly panels 50 of the body 14 extending in a horizontal direction substantially parallel to the floor 24 of the base 12 (or to the roof 88 of the cap 20). For example, in embodiments where the base 12 is omitted from the container 10, the key panels 44, 46, the inner bracket panels 48, and the outer butterfly panels 50 of the body 14 may be stored within the opening in the cap 20.

In at least some embodiments, the base 12, the cap 20, the first and/or second duplex panel structures 40, 42, and/or the first and/or second key panels 44, 46 may be composites. For example, depending on the strength requirements of the container 10 and/or the size of the interior storage cavity 22, in some embodiments, it may be necessary to bond, laminate, or otherwise join together more than one sheet of material to achieve a desired strength, rigidity, or size for the base 12, the cap 20, the first and/or second duplex panel structures 40, 42, and/or the first and/or second key panels 44, 46 of the container 10. As another example, it may be desirable to reinforce one or more of the sidewalls 34 and/or the inner and/or outer end walls 54, 64 of the container 10, for example, by bonding another sheet or panel of material to an inner or outer surface thereof. Some examples of materials that may be used to reinforce the sidewalls 34 and/or the inner and/or outer end walls 54, 64 of the container 10 include: fiberboard, plastic sheeting, corrugated fiberboard, corrugated plastic, honeycomb paper, honeycomb plastic, extruded plastic, wood, and combinations thereof. For example, in at least some embodiments, each of the key panels 44, 46 may be manufactured from a one-piece blank of single wall, double wall, or triple wall corrugated board having another piece of single wall, double wall, or triple wall corrugated board bonded to the inner and/or outer surfaces 78, 80 of the sidewall 34. In one specific example, sheets of reinforcing material may be bonded to outer surfaces 69 of the outer end walls 64 and/or outer surfaces 80 of the sidewalls 34. Bonding sheets of reinforcing material to the outer surfaces 80 of the sidewalls 34 may provide the sidewalls 34 of the container 10 with desired rigidity and strength, without increasing the thickness of the end flaps 74, which might otherwise interfere with the interlocking and overlapping relationship between the inner and outer end walls 54, 64 and the end flaps 74. In another example, sheets of reinforcing material may be bonded to inner surfaces 60 of the inner end walls 54 and/or inner surfaces 78 of the sidewalls.

In at least some embodiments, the base 12, the cap 20, the first and/or second duplex panel structures 40, 42, and/or the first and/or second key panels 44, 46 may include multiple score lines so that each of these components can be folded at different locations and used to form containers 10 of different sizes.

In the embodiment depicted in FIGS. 1-4, the container 10 and the internal cavity 22 defined between the floor 24, the end walls 32, the sidewalls 34, and the roof 88 of the container 10 exhibit a rectangular cuboid or a rectangular box shape, with all sides (i.e., the floor 24, the end walls 32, the sidewalls 34, and the roof 88) of the container 10 being rectangular in shape and all adjacent sides of the container 10 meeting in a right angle. In FIGS. 1-4, the end walls 32 have a width W and a height H and the sidewalls 34 have a length L and a height H, with the length L of the sidewalls 34 being greater than the width W of the end walls 32, the height H of the end walls 32 and the sidewalls 34 being substantially the same, and the height H of the end walls 32 and the sidewalls 34 being greater than the width W of the end walls 32. However, in other embodiments, the container 10 may exhibit other three-dimensional polyhedral shapes. For example, in one form, the container 10 may exhibit a square cuboid or a square box shape, with the height H of the end walls 32 and the sidewalls 34 being substantially the same as the width W of the end walls 32. In another form, the container 10 may be cubic in shape, with all sides of the container 10 being cubic in shape. In such case, the height H of the end walls 32 and the sidewalls 34 will be substantially the same as the width W of the end walls 32 and the length L of the sidewalls 34.

In the embodiment depicted in FIGS. 1-4, the first and second duplex panel structures 40, 42 each define one of the end walls 32 of the container 10 and thus also define a width W of the container 10. At the same time, the first and second key panels 44, 46 each define one of the sidewalls 34 of the container 10 and thus also define a length L of the container 10. However, in other embodiments, each of the end walls 32 of the container 10 (and thus the width W of the container 10) may be defined by two of more duplex panel structures (not shown). In at least some embodiments, the first and second duplex panel structures 40, 42 each may define one of the sidewalls 34 of the container 10 and thus also may define a length L of the container 10, and the first and second key panels 44, 46 each may define one of the end walls 32 of the container 10 and thus also may define a width W of the container 10.

In the embodiment depicted in FIGS. 1-4, the free ends 57 of the lateral side flaps 56 of the first duplex panel structure 40 are located opposite and extend toward the free ends 57 of the lateral side flaps 56 of the second duplex structure 42. And, as shown best in FIG. 3, a gap G exists between the opposed free ends 57 of the first and second duplex panel structures 40, 42. However, in other embodiments, the lateral side flaps 56 may be dimensioned so that the free ends 57 of the lateral side flaps 56 abut one another at a midway point along the key panels 44, 46, with the lateral side flaps 56 of the first and second duplex panel structures 40, 42 extending along and substantially covering the inner surfaces 78 of the sidewalls 34.

In FIGS. 1-4, the free ends 35 of the upper flaps 66 of the first duplex panel structure 40 are located opposite and extend toward the free ends 35 of the upper flaps 66 of the second duplex structure 42. In some embodiments, the free ends 35 of the upper flaps 66 may extend partway toward each other and partially over the top end 16 of the body 14. In other embodiments, the upper flaps 66 may be dimensioned so that, in assembly, the free ends 35 of the upper flaps 66 abut one another and extend entirely over the top end 16 of the body 14.

The container 10 depicted in FIGS. 1-4 consists of the base 12, the body 14, and the cap 20, which together define the interior storage cavity 22 within the container 10. However, in other embodiments, the base 12 and/or the cap 10 may be omitted and the container 10 may consist of the body 14. In such case, the interior storage cavity 22 may be entirely defined by the various components of the body 14. Without being bound by theory, it is believed that the interlocking and overlapping relationship between the inner and outer end walls 54, 64 of the first and second duplex panel structures 40, 42 and the end flaps 74 of the key panels 44, 46 can effectively retain the first and second duplex panel structures 40, 42 in position adjacent the key panels 44, 46, without use of any additional component(s) tied or otherwise secured around the body 14. Omitting the base 12 and/or the cap 10 from the container 10 can reduce the amount of material and the amount of time required to manufacture and assemble the container 10. In embodiments where it is desired to cover the top and bottom ends 16, 18 of the body 14, upper and/or lower flaps respectively extending from upper and/or lower ends of the inner and/or outer end walls 54, 64 and/or the sidewalls 34 may be employed and configured to partially or entirely cover the top and bottom ends 16, 18 of the body 14.

FIGS. 5-8 illustrate another container 110 for protecting, storing, and transporting goods, in accordance with one or more embodiments of the present disclosure. The container 110 depicted in FIGS. 5-8 is similar in many respects to the container 10 of FIGS. 1-4 and like numerals between the embodiments generally designate like or corresponding elements throughout the several views of the drawing figures. Subject matter common to the embodiments generally may not be repeated here.

Figure 7:
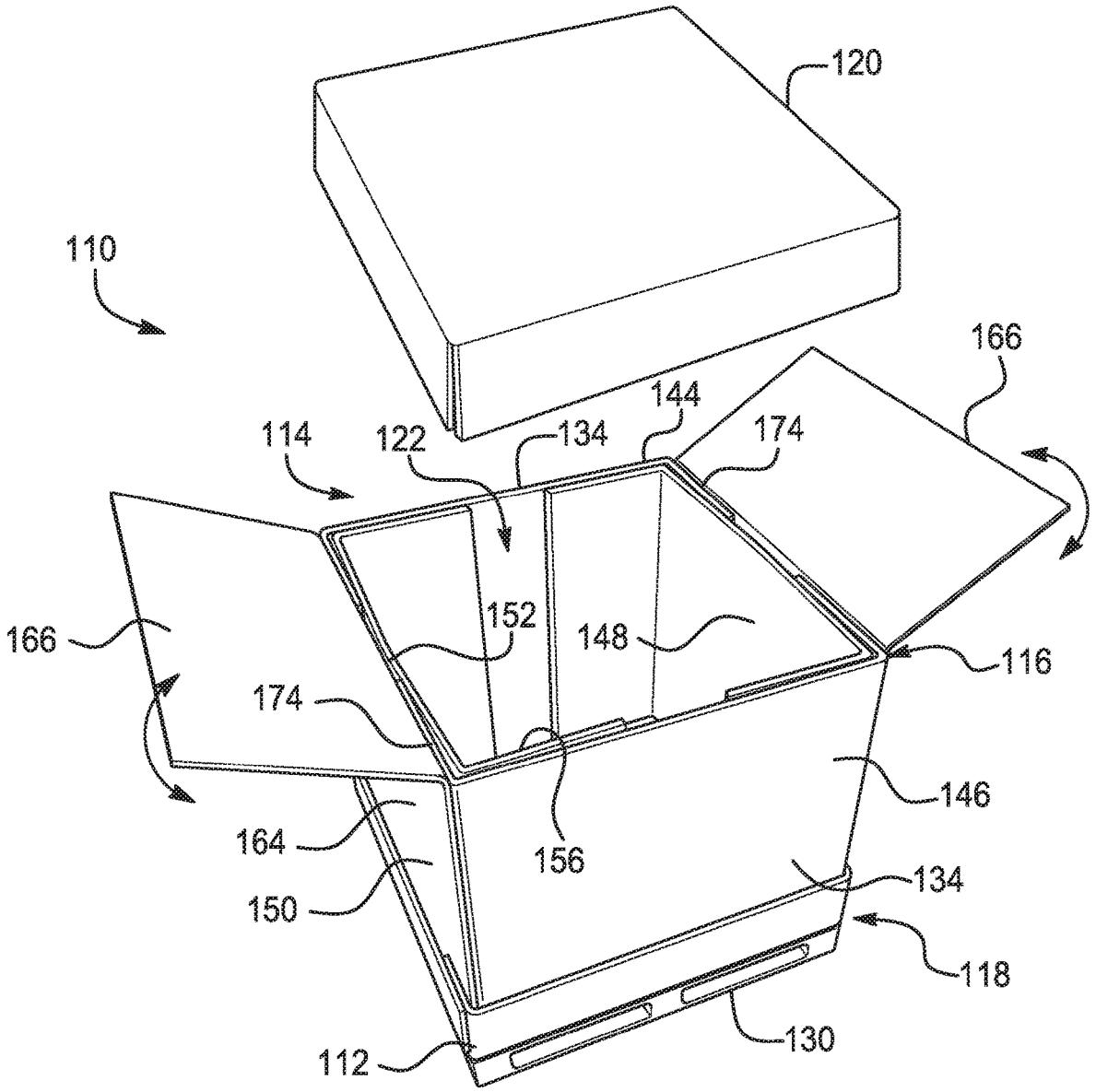
FIG. 7 a perspective view of a container including the body of FIG. 6, wherein a bottom end of the body is received in a socket defined in a base and mounted on a pallet.

As best shown in FIG. 7, the container 110 comprises a body 114 including a top end 116 and a bottom end 118, a base 112, and a cap 120. Like the container 10, the container 110 may be mounted on a pallet 130 (FIGS. 7-8) and may be moveable between a use position (FIG. 7), in which the body 114 of the container 110 extends in a vertical direction from the base 112 and at least partially defines an interior storage cavity 122 within the container 110, and a knock-down storage position (FIG. 8), in which the body 114 of the container 110 is folded substantially flat and stored within the base 112.

Figure 5:
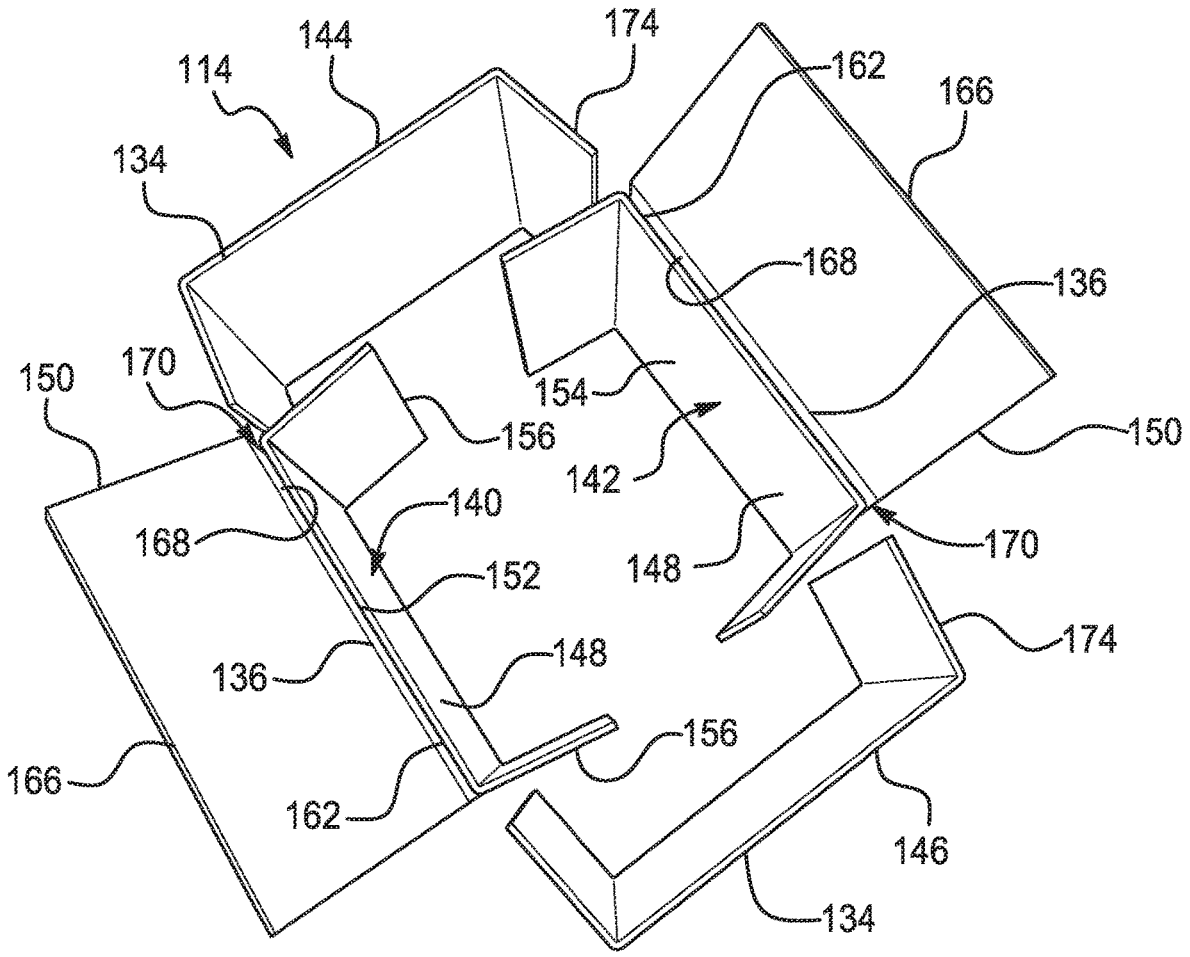
FIG. 5 is a perspective view of a body of another container in partially assembled form, wherein the body of the container includes a pair of opposing duplex panel structures and a pair of opposing key panels.
Figure 6:
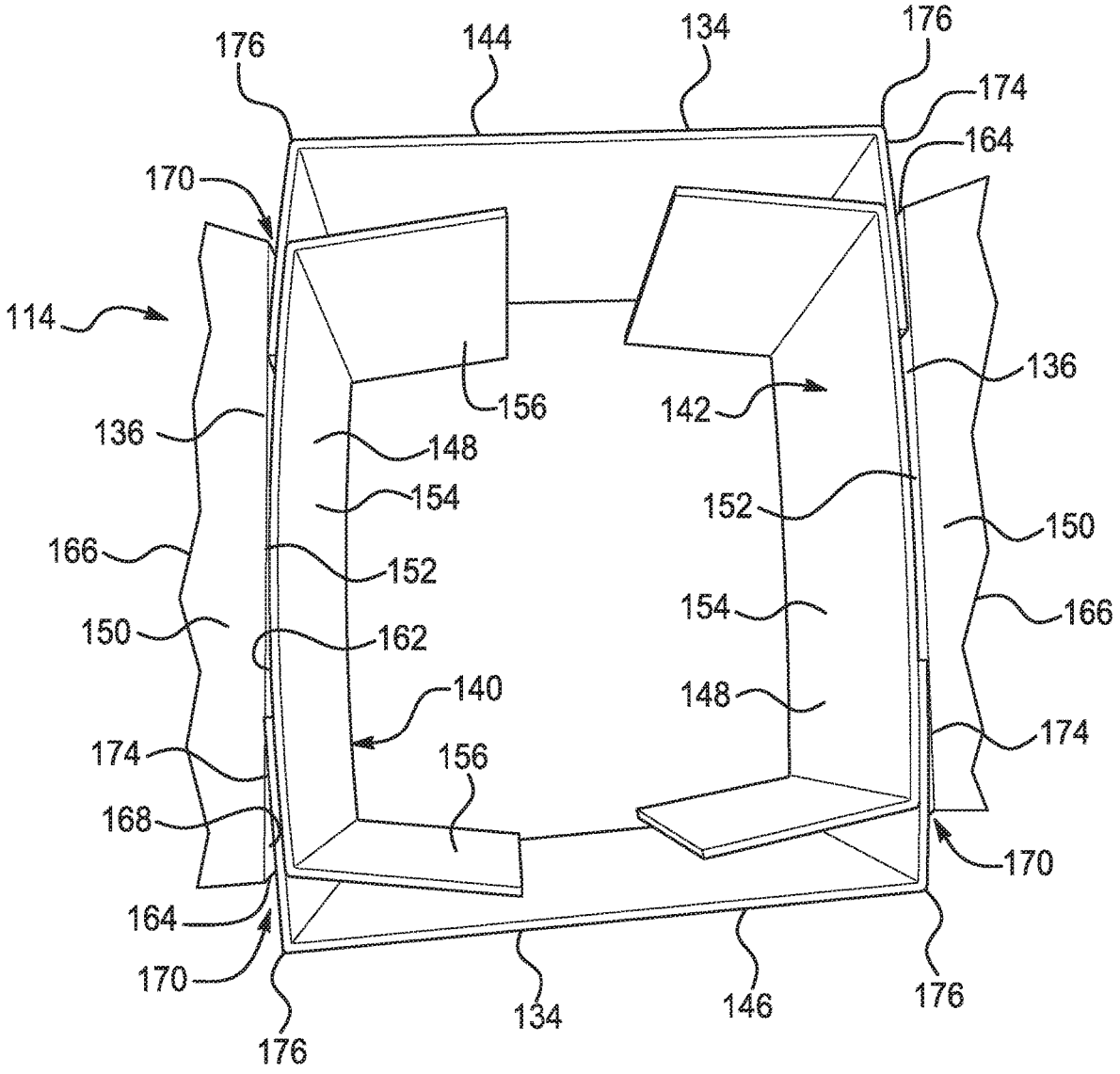
FIG. 6 is a top view of the body of FIG. 5 during assembly thereof, wherein end flaps of the key panels are partially inserted into slots formed in the duplex panel structures.

Referring now to FIGS. 5 and 6, the body 114 of the container 110 comprises a pair of opposing first and second duplex panel structures 140, 142 and a pair of opposing first and second key panels 144, 146. Each of the duplex panel structures 140, 142 comprises an inner bracket panel 148 and an outer butterfly panel 150 coupled to the inner bracket panel 148 along a medial longitudinal spine 152. Each of the inner bracket panels 148 defines an inner end wall 154 of the container 110 and a pair of lateral side flaps 156 extending from opposite sides of the inner end walls 154. Each of the outer butterfly panels 150 defines an outer end wall 164 (FIG. 7) and an upper flap 166 extending from an upper end 136 of the outer end wall 164. In one form, each of the inner bracket panels 148 and/or the outer butterfly panels 150 may be formed from a one-piece blank or sheet, e.g., of corrugated board.

During assembly of the duplex panel structures 140, 142, the inner bracket panels 148 and the outer butterfly panels 150 are positioned adjacent one another, with outer surfaces 162 of the inner end walls 154 facing toward inner surfaces 168 of the outer end walls 164. The outer surfaces 162 of the inner end walls 154 are physically coupled to the inner surfaces 168 of the outer end walls 164 along the medial longitudinal spine 152, for example, by placing a line or strip of adhesive material along a medial longitudinal portion of the outer and/or inner surfaces 162, 168, and then pressing the outer and inner surfaces 162, 168 together. After the inner bracket panels 148 and the outer butterfly panels 150 are coupled to one another, a pair of slots 170 are defined between the outer surfaces 162 of the inner end walls 154 and the inner surfaces 168 of the outer end walls 164.

Each of the first and second key panels 144, 146 defines a sidewall 134 of the container 110 and a pair of lateral end flaps 174 extending from opposite sides 176 of the sidewall 134. As best shown in FIG. 6, during assembly of the body 114 of the container 110, the end flaps 174 are received within the slots 170 defined between the outer surfaces 162 of the inner end walls 154 and the inner surfaces 168 of the outer end walls 164 to lock the key panels 144, 146 in position adjacent the duplex panel structures 140, 142 of the body 114. In one form, each of the first and second key panels 144, 146 may be formed from a one-piece blank or sheet, e.g., of corrugated board.

As shown in FIG. 7, after assembly of the body 114, the bottom end 118 of the body 114 is received in the base 112. Then, the upper flaps 166 (when present) of the outer butterfly panels 150 are folded inward toward the interior storage cavity 122 and the cap 120 is positioned over and around the top end 116 of the body 114 (not shown).

Figure 8:
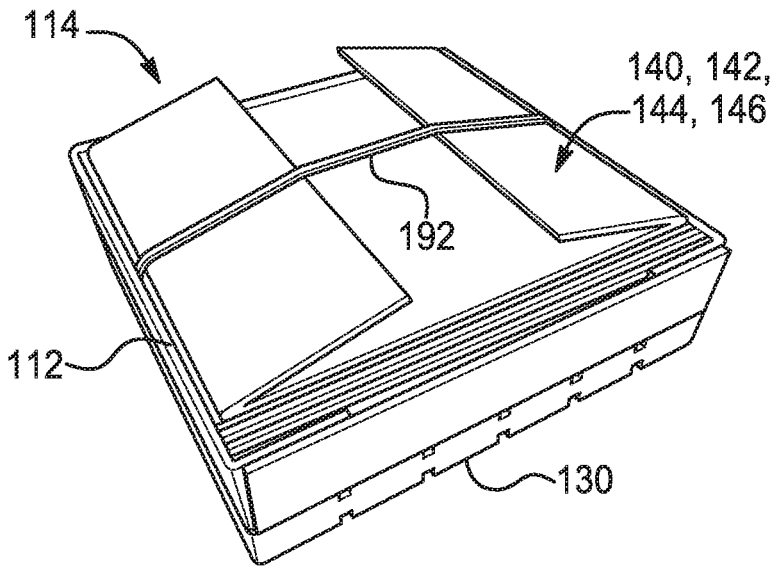
FIG. 8 is a perspective view of the container of FIG. 7 in a storage position, with the key panels and the duplex panel structures disengaged from one another, folded substantially flat, and stacked on top of one another in the socket defined in the base.

As shown in FIG. 8, the container 110 may be transitioned from a use position to a knock-down storage position by removing the cap 120 from the body 114 and disassembling the body 114. The body 114 may be disassembled by disengaging the key panels 144, 146 and the duplex panel structures 140, 142 from one another and folding the key panels 144, 146 and the duplex panel structures 140, 142 into a substantially flat arrangement. Then, the key panels 144, 146 and the duplex panel structures 140, 142 may be stacked on top of one another in the base 112, and the cap 120 may be positioned over and around the base 112, enclosing the key panels 144, 146 and the duplex panel structures 140, 142 therein (not shown). In at least some embodiments, a strap 192 may be wrapped around the panels 144, 146 and the panel structures 140, 142 so that the panels 144, 146 and the panel structures 140, 142 are held together in a substantially flat arrangement when the container 110 is in the storage position.

Figure 9:
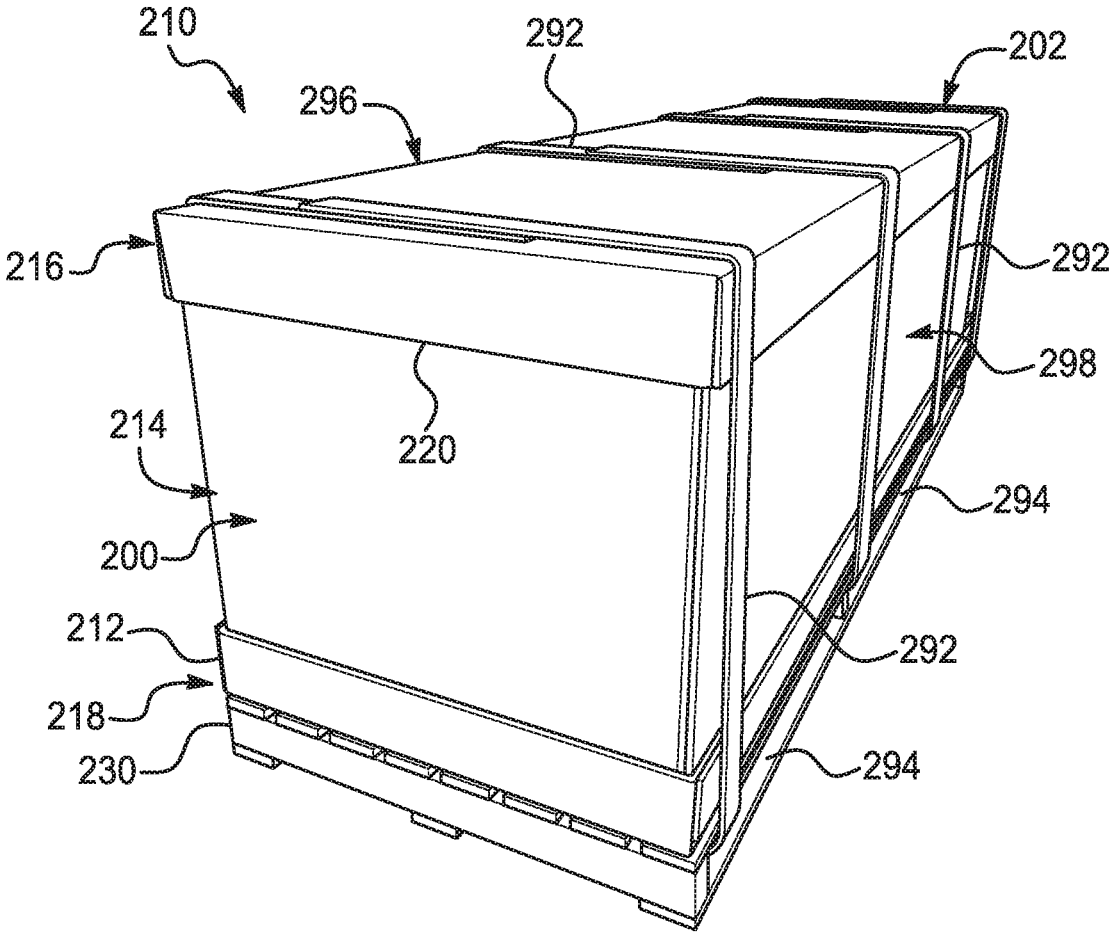
FIG. 9 is a perspective view of another container in a use position, wherein the container comprises a body having a bottom end received within a base mounted on a pallet and a top end enclosed by a cap.
Figure 10:
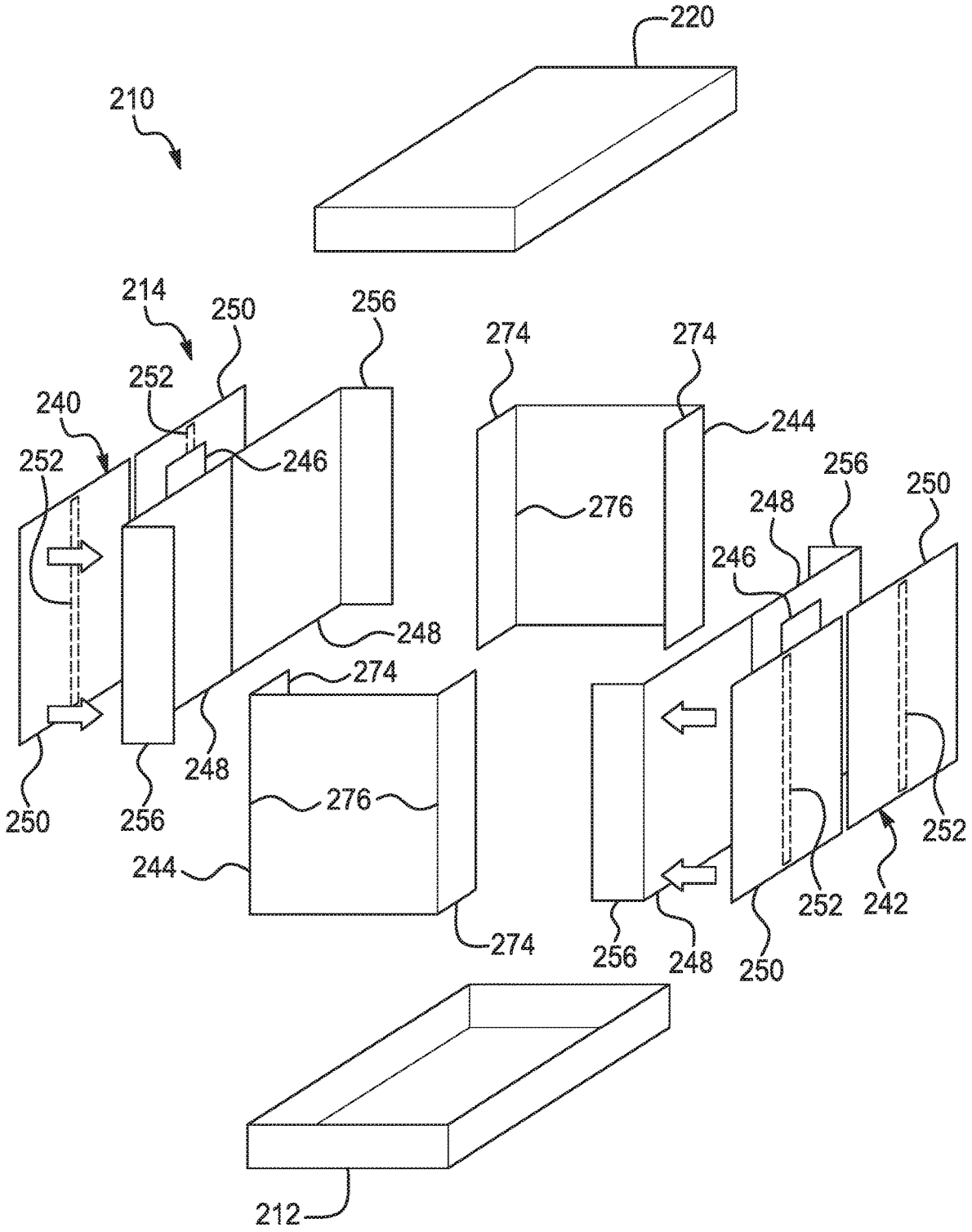
FIG. 10 is an exploded perspective view of the container of FIG. 9, wherein the body of the container includes first and second pairs of duplex panel structures, a pair of opposing key panels, and a pair of opposing battens.
Figure 11:
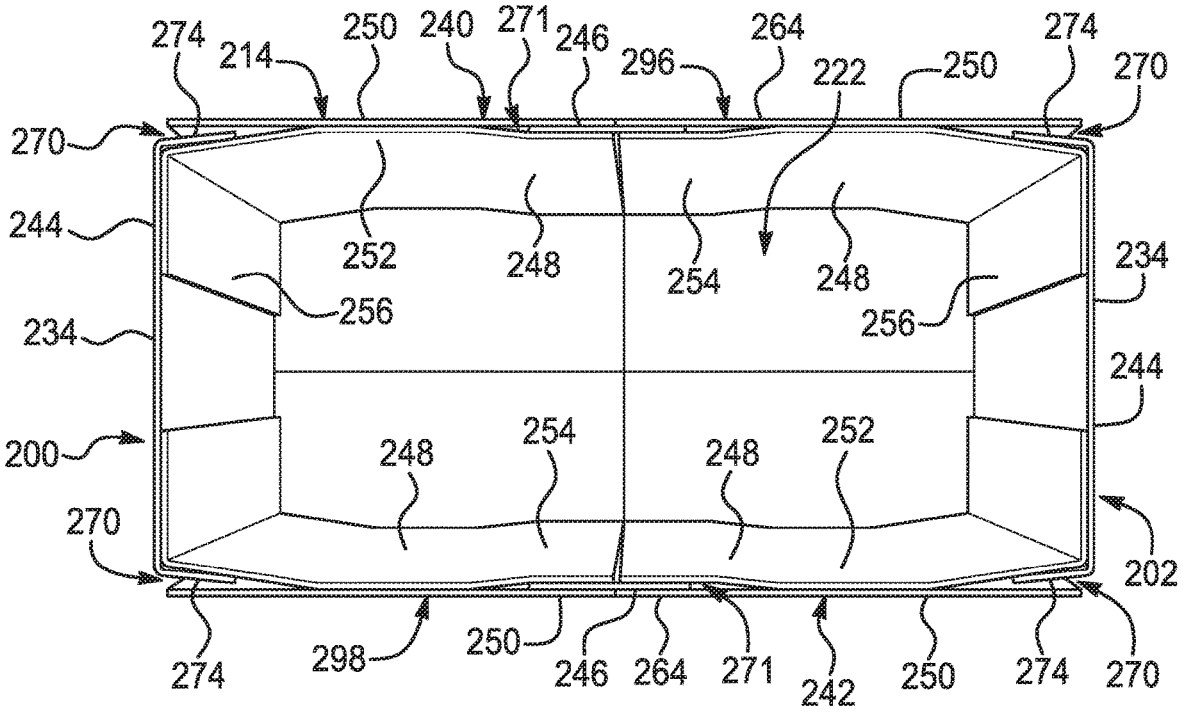
FIG. 11 is a top view of the body of the container of FIG. 10.

FIGS. 9-11 illustrate another container 210 for protecting, storing, and transporting goods, in accordance with one or more embodiments of the present disclosure. The container 210 depicted in FIGS. 9-10 is similar in many respects to the containers 10, 110 of FIGS. 1-8 and like numerals between the embodiments generally designate like or corresponding elements throughout the several views of the drawing figures. Subject matter common to the embodiments generally may not be repeated here.

The container 210 comprises a body 214 including a top end 216 and a bottom end 218, a base 212, and a cap 220. Like the containers 10, 110, the container 210 may be mounted on a pallet 230 and may be moveable between a use position (FIG. 9), in which the body 214 of the container 210 at least partially defines an interior storage cavity 222 (FIG. 11) within the container 210, and a knock-down storage position (not shown), in which the body 214 of the container 210 is stored within the base 212. In at least some embodiments, when the container 210 is in the use position and mounted on the pallet 230, one or more straps 292 may wrapped around the container 210 (around the body 214, the base 212, and the cap 202) and through one or more openings 294 in the pallet 230 to help secure the container 210 on the pallet 230.

Referring now to FIGS. 10-11, the body 214 of the container 210 comprises a first pair of duplex panel structures 240 disposed on a first side 296 of the body 214, a second pair of duplex panel structures 242 disposed on a second side 298 of the body 214, a pair of opposing key panels 244 respectively located at first and second ends 200, 202 of the body 214, and a pair of opposing battens 246 positioned midway between the first and second ends 200, 202 of the body 214.

Each of the duplex panel structures 240, 242 comprises an inner bracket panel 248 and an outer butterfly panel 250 coupled to the inner bracket panel 248 along a medial longitudinal spine 252. Each of the inner bracket panels 248 defines a portion of an inner side wall 254 (FIG. 11) of the container 210 and optionally a lateral side flap 256 extending along the first or second end 200, 202 of the body 214. Each of the outer butterfly panels 250 defines a portion of an outer side wall 264 (FIG. 11) of the container 210. In some embodiments, the outer butterfly panels 250 may include upper and/or lower flaps respectively extending from upper and lower ends of the outer side wall 264 of the container 210. In one form, each of the inner bracket panels 248 and/or the outer butterfly panels 250 may be formed from a one-piece blank or sheet, e.g., of corrugated board. The duplex panel structures 240, 242 may be assembled in the same manner as the duplex panel structures 140, 142 of FIGS. 5-8. After the inner bracket panels 248 and the outer butterfly panels 250 are coupled to one another along the medial longitudinal spine 252, a pair of first and second slots 270, 271 are defined therebetween. In particular, after the inner bracket panels 248 and the outer butterfly panels 250 are coupled to one another along the medial longitudinal spine 252, a first slot 270 is defined therebetween on one side of the medial longitudinal spine 252 and a second slot 271 is defined therebetween on the opposite side of the medial longitudinal spine 252. The first slots 270 defined between the inner bracket panels 248 and the outer butterfly panels 250 of the first and second pairs of duplex panel structures 240, 242 are located at the first and second ends 200, 202 of the body 214. The second slots 271 defined between the inner bracket panels 248 and the outer butterfly panels 250 of the first and second pairs of duplex panel structures 240, 242 are located midway between the first and second ends 200, 202 of the body 214.

Each of the key panels 244 defines an end wall 234 of the container 210 and a pair of lateral end flaps 274 extending from opposite sides 276 thereof. As best shown in FIG. 11, during assembly of the body 214 of the container 210, the end flaps 274 are received within the first slots 270 defined between the inner bracket panels 248 and the outer butterfly panels 250 at the first and second ends 200, 202 of the body 214 to lock the key panels 244 in position adjacent the duplex panel structures 240, 242 of the body 214. In one form, each of the key panels 244 may be formed from a one-piece blank or sheet, e.g., of corrugated board.

The pair of opposing battens 246 are disposed in the second slots 271 defined between the inner bracket panels 248 and the outer butterfly panels 250 of the first and second pairs of duplex panel structures 240, 242. More specifically, a first one of the battens 246 on the first side 296 of the body 214 extends between the inner bracket panels 248 and the outer butterfly panels 250 of the first pair of duplex panel structures 240 to lock the first pair of duplex panel structures 240 in position adjacent one another on the first side 296 of the body 214. At the same time, a second one of the battens 246 on the second side 298 of the body 214 extends between the inner bracket panels 248 and the outer butterfly panels 250 of the second pair of duplex panel structures 242 to lock the second pair of duplex panel structures 242 in position adjacent one another on the second side 298 of the body 214.

Figure 12:
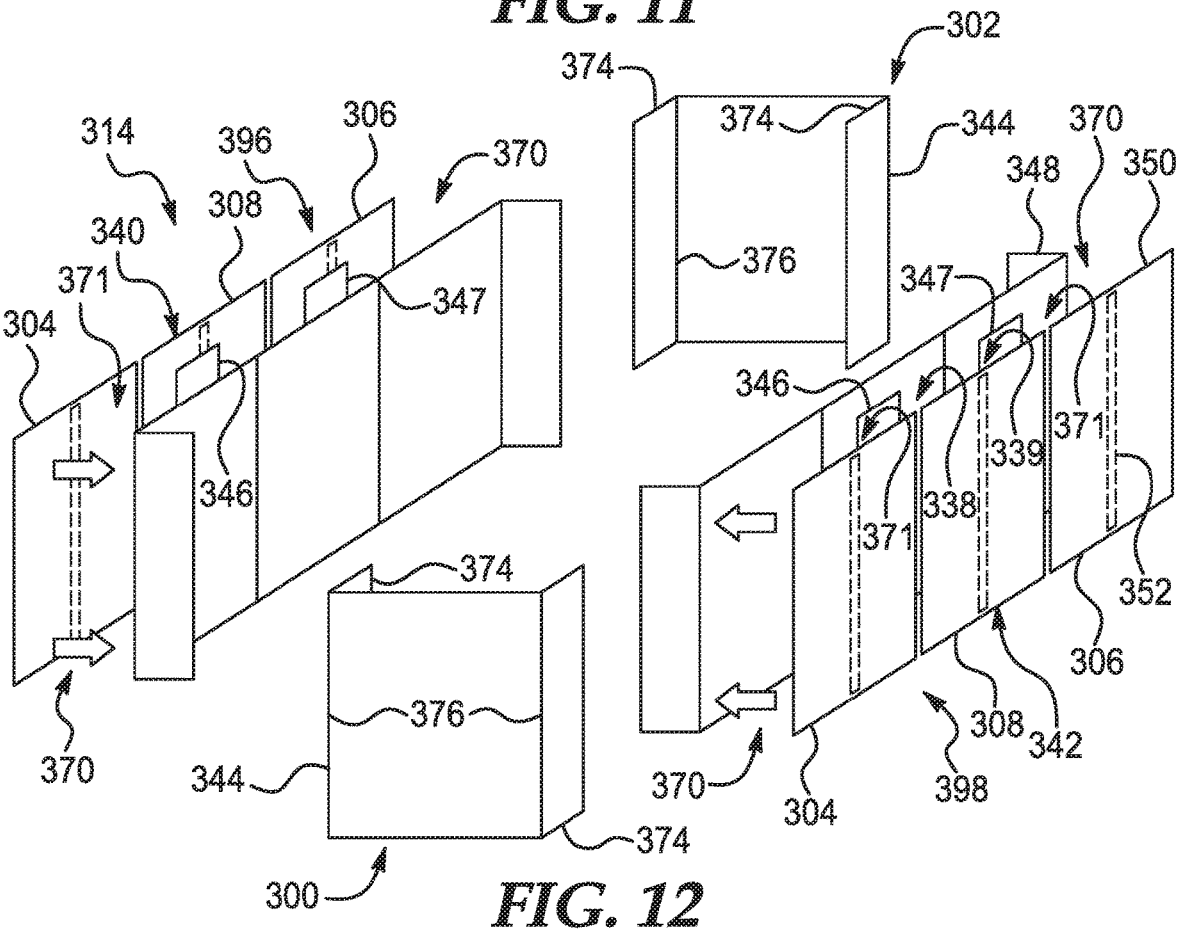
FIG. 12 is an exploded perspective view of a body of another container, wherein the body of the container includes first and second sets of duplex panel structures, a pair of opposing key panels, and first and second pairs of opposing battens.

FIG. 12 illustrates a body 314 of another container (not shown) for protecting, storing, and transporting goods, in accordance with one or more embodiments of the present disclosure. The body 314 depicted in FIG. 12 is similar in many respects to the bodies 14, 114, 214 of FIGS. 1-11 and like numerals between the embodiments generally designate like or corresponding elements throughout the several views of the drawing figures. Subject matter common to the embodiments generally may not be repeated here.

The body 314 comprises a first set of duplex panel structures 340 disposed on a first side 396 of the body 314, a second set of duplex panel structures 342 disposed on a second side 398 of the body 314, a pair of opposing key panels 344 respectively located at first and second ends 300, 302 of the body 314, and first and second pairs of opposing battens 346, 347 positioned between the first and second ends 300, 302 of the body 314.

In the embodiment depicted in FIG. 12, the first and second sets of duplex panel structures 340, 342 each include a first duplex panel structure 304 disposed at the first end 300 of the body 314, a second duplex panel structure 306 disposed at the second end 302 of the body 314, and an intermediate duplex panel structure 308 disposed between the first and second duplex panel structures. Each of the duplex panel structures 304, 306, 308 comprises an inner bracket panel 348 and an outer butterfly panel 350 coupled to the inner bracket panel 348 along a medial longitudinal spine 352.

With respect to the first and second duplex panel structures 306, 306, after the inner bracket panels 348 and the outer butterfly panels 350 are coupled to one another along the medial longitudinal spine 352, first and second slots 370, 371 are defined therebetween on opposite sides of the medial longitudinal spine 352. With respect to the intermediate duplex panel structures 308, after the inner bracket panels 348 and the outer butterfly panels 350 are coupled to one another along the medial longitudinal spine 352, third and fourth slots 338, 339 are defined therebetween on opposite sides of the medial longitudinal spine 352. The first slots 270 defined between the inner bracket panels 248 and the outer butterfly panels 250 of the first and second duplex panel structures 304, 306 are located at the first and second ends 300, 302 of the body 314. The second slots 371 defined between the inner bracket panels 348 and the outer butterfly panels 350 of the first and second duplex panel structures 304, 306 are respectively located adjacent the third and fourth slots 338, 339 defined between the inner bracket panels 348 and the outer butterfly panels 350 of the intermediate duplex panel structures 308. The second, third, and fourth slots 371, 338, 339 are located between the first and second ends 300, 302 of the body 314.

Each of the key panels 344 includes a pair of lateral end flaps 374 extending from opposite sides 376 thereof. During assembly of the body 314, the end flaps 374 are received within the slots 270 defined between the inner bracket panels 248 and the outer butterfly panels 250 of the first and second duplex panel structures 304, 306 to lock the key panels 344 in position adjacent the first and second duplex panel structures 304, 306 of the body 314. The first duplex panel structures 304 are locked into position adjacent the intermediate duplex panel structures 308 by the first pair of opposing battens 346, which are received in the second and third slots 371, 338 defined by the first duplex panel structures 304 and the intermediate duplex panel structures 308. In addition, the second duplex panel structures 306 are locked into position adjacent the intermediate duplex panel structures 308 by the second pair of opposing battens 347, which are received in the second and fourth slots 371, 339 defined by the second duplex panel structures 306 and the intermediate duplex panel structures 308.

It is to be understood that the foregoing is a description of one or more preferred exemplary embodiments of the invention. The invention is not limited to the particular embodiment(s) disclosed herein. Various other embodiments and various changes and modifications to the disclosed embodiment(s) will become apparent to those skilled in the art. For example, in at least some embodiments, more than one intermediate duplex panel structure 308 may be disposed between the first and second duplex panel structures 304, 306 as needed to produce a container having a desired length and/or width. The inclusion of each additional intermediate duplex panel structure 308 on the first and/or second sides 396, 398 of the body 314 will necessitate the inclusion of one additional batten. As another example, in at least some embodiments, one or both of the key panels 44, 46, 144, 146, 244, 344 may be replaced by one or more duplex panel structures 40, 42, 140, 142, 240, 242, 340, 342 to produce a container having a desired length and/or width.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A container comprising:

a body having a top end, an opposite bottom end, a pair of opposing first and second duplex panel structures, and a pair of opposing first and second sidewalls extending between the first and second duplex panel structures, with each of the first and second sidewalls including a pair of first and second lateral end flaps extending from opposite sides thereof, wherein each of the first and second duplex panel structures comprises an inner end wall having an outer surface and an outer end wall having an inner surface, wherein the outer and inner surfaces of the inner and outer end walls of each of the first and second duplex panel structures confront one another and are bonded together along a medial longitudinal spine that extends between the top and bottom ends of the body, and wherein each of the first and second lateral end flaps of the first and second sidewalls is sandwiched between the outer and inner surfaces of the inner and outer end walls of one of the first or second duplex panel structures to lock the first and second sidewalls in position adjacent the first and second duplex panel structures.

2. The container set forth in claim 1 wherein free ends of the first and second lateral end flaps of the first sidewall are located opposite and extend toward free ends of the first and second lateral end flaps of the second sidewall.

3. The container set forth in claim 2 wherein the free ends of the first and second lateral end flaps of the first sidewall are respectively separated from the free ends of the first and second lateral end flaps of the second sidewall by the medial longitudinal spines of the first and second duplex panel structures.

4. The container set forth in claim 1 wherein the bottom end of the body is mounted on a base.

5. The container set forth in claim 1 wherein the top end of the body is enclosed by a cap.

6. The container set forth in claim 1 wherein each of the first and second duplex panel structures includes a pair of lateral side flaps extending from opposite sides of its inner end wall.

7. The container set forth in claim 1 wherein each of the first and second duplex panel structures includes an upper flap extending from an upper end of its outer end wall.

8. A container comprising:

a cap;

a base;

a body having a top end and a bottom end adapted for receipt in the base, the body comprising:

a pair of first and second duplex panel structures having opposing inner surfaces, with each duplex panel structure comprising an inner bracket panel and an outer butterfly panel coupled to the inner bracket panel along a medial longitudinal spine, the inner bracket panel being formed from a one-piece blank that defines an inner end wall and a pair of lateral side flaps, and the outer butterfly panel being formed from a one-piece blank that defines an outer end wall having an inner surface that faces toward an outer surface of the adjacent inner end wall; and a pair of first and second key panels having opposing inner surfaces, with each key panel being formed from a one-piece blank that defines a sidewall and a pair of first and second lateral end flaps, wherein, each of the lateral end flaps of the key panels is sandwiched between the outer surface of one of the inner end walls and the inner surface of the adjacent outer end wall to lock the inner and outer end walls in position adjacent the sidewalls.

9. The container set forth in claim 8 wherein each of the lateral end flaps of the key panels is held between the outer surface of one of the inner end walls and the inner surface of the adjacent outer end wall without use of an adhesive material or fastener between the lateral end flap and the adjacent inner or outer end walls.

10. The container set forth in claim 8 wherein the key panels are held in position adjacent the duplex panel structures without use of an additional component tied or otherwise secured around a periphery of the body.

11. The container set forth in claim 8 wherein the opposing inner surfaces of the duplex panel structures are defined by inner surfaces of the inner end walls of the inner bracket panels, and wherein the opposing inner surfaces of the key panels are defined by inner surfaces of the sidewalls.

12. The container set forth in claim 8 wherein the inner bracket panel and the outer butterfly panel are coupled to each other along the medial longitudinal spine by an adhesive material.

13. The container set forth in claim 8 wherein each of the outer butterfly panels includes an upper flap, and wherein each of the outer end walls of the butterfly panels is joined to one of the upper flaps along a fold line, and wherein the upper flaps fold inward toward each other, over upper ends of the inner bracket panels, prior to positioning the cap over the top end of the body.

14. The container set forth in claim 8 wherein the base, the inner bracket panel, the outer butterfly panel, the key panels, and the cap are each formed of individual corrugated board blanks.

15. The container set forth in claim 8 wherein the sidewalls of the first and second key panels have sidewall lengths and the inner end walls have end wall lengths, and wherein the sidewall lengths are greater than the end wall lengths.

16. The container set forth in claim 8 wherein the base is mounted on a pallet.

17. The container set forth in claim 8 wherein the cap is formed from a one-piece blank and includes a roof and a flange depending from the roof, and wherein the cap is telescopically positioned over and around the top end of the body to define an interior storage cavity.

18. The container set forth in claim 17 wherein the roof of the cap is supported by the top end of the body.

19. The container set forth in claim 18 wherein the base is formed from a one-piece blank and includes a floor and a peripheral sidewall extending from the floor, and wherein the floor and the peripheral sidewall of the base together define a socket in which the bottom end of the body is telescopically received.

20. The container set forth in claim 19 wherein the container is moveable between a use position, in which the inner and outer end walls of the first and second duplex panel structures and the sidewalls of the first and second key panels extend in a vertical direction from the floor of the base to the roof of the cap, and a storage position, in which the first and second duplex panel structures and the first and second key panels are stacked on top of one another and stored within the socket of the base, and wherein, in the storage position, the inner and outer end walls of the first and second duplex panel structures and the sidewalls of the first and second key panels extend in a horizontal direction substantially parallel to the floor of the base.

21. A container comprising:

a body having a first end, an opposite second end, a pair of opposing first and second duplex panel structures disposed at the first end of the body, a pair of opposing third and fourth duplex panel structures disposed at the second end of the body, a first key panel extending between the first and second duplex panel structures at the first end of the body, and a second key panel extending between the third and fourth duplex panel structures at the second end of the body, wherein each duplex panel structure comprises an inner bracket panel and an outer butterfly panel coupled to the inner bracket panel along a medial longitudinal spine, wherein the first and second key panels have opposing inner surfaces, wherein each of the first and second key panels is formed from a one-piece blank that defines an end wall of the container and a pair of first and second lateral end flaps, wherein the first and second lateral end flaps of the first key panel are respectively sandwiched between the inner bracket panels and the outer butterfly panels of the first and second duplex panel structures to lock the first key panel in position adjacent the first and second duplex panel structures at the first end of the body, and wherein the first and second lateral end flaps of the second key panel are respectively sandwiched between the inner bracket panels and the outer butterfly panels of the third and fourth duplex panel structures to lock the second key panel in position adjacent the third and fourth duplex panel structures at the second end of the body.

22. The container set forth in claim 21 wherein the first and third duplex panel structures at least partially define a first sidewall of the container extending between the first and second ends of the body, and wherein the second and fourth duplex panel structures at least partially define a second sidewall of the container opposite the first sidewall and extending between the first and second ends of the body.

23. The container set forth in claim 21 comprising: a pair of opposing first and second battens disposed between the first and second ends of the body, wherein the first batten is partially sandwiched between the inner bracket panel and the outer butterfly panel of the first or third duplex panel structure, and wherein the second batten is partially sandwiched between the inner bracket panel and the outer butterfly panel of the second or fourth duplex panel structure.

24. The container set forth in claim 23 wherein each of the first and second battens are formed from a one-piece blank.

25. The container set forth in claim 23 wherein the opposing first and second battens are disposed midway between the first and second ends of the body, the first batten is sandwiched between the inner bracket panels and the outer butterfly panels of the first and third duplex panel structures to lock the first and third duplex panel structures in position adjacent one another on a first side of the body, and the second batten is sandwiched between the inner bracket panels and the outer butterfly panels of the second and fourth duplex panel structures to lock the second and fourth duplex panel structures in position adjacent one another on an opposite second side of the body.

26. The container set forth in claim 25 wherein the first and third duplex panel structures together define a first sidewall of the container extending between the first and second ends of the body, and wherein the second and fourth duplex panel structures together define an opposite second sidewall of the container extending between the first and second ends of the body.

27. The container set forth in claim 23 comprising a pair of opposing fifth and sixth duplex panel structures disposed between the first and second ends of the body, and a pair of opposing third and fourth battens disposed between the first and second ends of the body.

28. The container set forth in claim 27 wherein the first, third, and fifth duplex panel structures together define a first sidewall of the container extending between the first and second ends of the body, and wherein the second, fourth, and sixth duplex panel structures together define an opposite second sidewall of the container extending between the first and second ends of the body.

29. The container set forth in claim 28 wherein the first batten is sandwiched between the inner bracket panels and the outer butterfly panels of the first and fifth duplex panel structures on a first side of the body, the second batten is sandwiched between the inner bracket panels and the outer butterfly panels of the second and sixth duplex panel structures on a second side of the body, the third batten is sandwiched between the inner bracket panels and the outer butterfly panels of the fifth and third duplex panel structures on the first side of the body, and the fourth batten is sandwiched between the inner bracket panels and the outer butterfly panels of the sixth and fourth duplex panel structures on the second side of the body.

30. The container set forth in claim 29 wherein the first and third battens lock the first, third, and fifth duplex panel structures together on the first side of the body, and wherein the second and fourth battens lock the second, fourth, and sixth duplex panel structures together on the second side of the body.

* * * * *